US009958831B2

(12) United States Patent
Di Domenico et al.

(10) Patent No.: US 9,958,831 B2
(45) Date of Patent: May 1, 2018

(54) TIMEPIECE RESONATOR MECHANISM

(71) Applicant: The Swatch Group Research and Development Ltd, Marin (CH)

(72) Inventors: Gianni Di Domenico, Neuchatel (CH); Dominique Lechot, Les Reussilles (CH); Jean-Luc Helfer, Le Landeron (CH); Pascal Winkler, St-Blaise (CH)

(73) Assignee: The Swatch Group Research and Development Ltd, Marin (CH)

( * ) Notice: Subject to any disclaimer, the term of this patent is extended or adjusted under 35 U.S.C. 154(b) by 0 days. days.

(21) Appl. No.: 15/410,294

(22) Filed: Jan. 19, 2017

(65) Prior Publication Data

US 2017/0227930 A1 Aug. 10, 2017

(30) Foreign Application Priority Data

Feb. 10, 2016 (EP) ..... 16155039

(51) Int. Cl.
*G04B 17/04* (2006.01)
*G04B 31/02* (2006.01)

(52) U.S. Cl.
CPC ..... *G04B 17/04* (2013.01); *G04B 31/02* (2013.01)

(58) Field of Classification Search
CPC ..... G04B 17/06; G04B 17/04; G04B 31/02; G04B 15/00; G04B 15/06; G04B 15/08; G04B 17/045; G04B 15/14; G04B 15/02; G04B 15/12; G04B 13/025; G04B 17/063; G04B 17/26; G04B 17/00; G04B 17/20; G04B 17/28; G04B 17/285; G04B 17/02
USPC ..... 368/161, 169, 127, 129–131
See application file for complete search history.

(56) References Cited

U.S. PATENT DOCUMENTS 9,134,705 B2 * 9/2015 Vardi ..... G04B 15/08
9,323,222 B2 * 4/2016 Stranczl ..... G04B 15/14
9,477,205 B2 * 10/2016 Born ..... G04B 17/045
2013/0176829 A1 7/2013 Cusin et al.
(Continued)

FOREIGN PATENT DOCUMENTS

EP 2 645 189 A1 10/2013
EP 2 911 012 A1 8/2015
(Continued)

OTHER PUBLICATIONS

European Search Report dated Jul. 29, 2016 in European Application 16155039.7, filed on Feb. 10, 2016 (with English Translation of Categories of cited documents).

*Primary Examiner* — Edwin A. Leon
(74) *Attorney, Agent, or Firm* — Oblon, McClelland, Maier & Neustadt, L.L.P.

(57) ABSTRACT

A watch or movement including a timepiece resonator movement including two RCC flexural pivots mounted in series about an intermediate rotary support and having the same virtual pivot axis, each including two straight flexible strips of the same length, whose clamping points opposite to this pivot axis are at the same distance with respect to this axis, and which define linear directions, forming angles, in pairs, with this virtual pivot axis, whose value expressed in degrees is comprised between:

$$109.5+5/[(D/L)-(2/3)] \text{ and } 114.5+5/[(D/L)-(2/3)],$$

or more particularly between 107+5/((D/L)−(2/3)) and 112+5/((D/L)−(2/3)).

14 Claims, 6 Drawing Sheets

(56) References Cited

U.S. PATENT DOCUMENTS

| | | | |
|---|---|---|---|
| 2015/0043313 | A1 | 2/2015 | Stranczl et al. |
| 2015/0063082 | A1 | 3/2015 | Stranczl et al. |
| 2015/0103636 | A1 | 4/2015 | Stranczl et al. |

FOREIGN PATENT DOCUMENTS

| | | | |
|---|---|---|---|
| EP | 3 021 174 | A1 | 5/2016 |
| WO | WO 2012/010408 | A1 | 1/2012 |

* cited by examiner

TIMEPIECE RESONATOR MECHANISM

This application claims priority from European Patent application 16155039.7 of Feb. 10, 2016, the entire disclosure of which is hereby incorporated herein by reference.

Field of the Invention

The invention concerns a timepiece resonator mechanism comprising a first support with a first anchor and a second anchor to which is attached a flexural pivot mechanism, which defines a virtual pivot axis about which rotatably pivots a pivoting weight, and which includes at least one front RCC flexural pivot and one back RCC flexural pivot, mounted in series and head-to-tail relative to each other about said virtual pivot axis, said front RCC flexural pivot including, between said first support and an intermediate rotary support, two straight flexible front strips of the same front length between their clamping points, defining two linear front directions which intersect at said virtual pivot axis and which define, with said virtual pivot axis, a front angle, and wherein the respective anchors of said two straight flexible front strips farthest from said virtual pivot axis are both at the same front distance from said virtual pivot axis, and said front RCC flexural pivot including, between said intermediate rotary support, which includes a third anchor and a fourth anchor, and said pivoting weight, two straight flexible back strips of the same back length between their clamping points, defining two linear back directions which intersect at said virtual pivot axis and which define, with said virtual pivot axis, a back angle, and wherein the respective anchors of said two straight flexible back strips farthest from said virtual pivot axis are both at the same back distance from said virtual pivot axis.

The invention also concerns a timepiece movement including at least one such resonator mechanism.

The invention also concerns a watch including at least one movement of this type.

The invention concerns the field of timepiece resonator mechanisms.

Background of the Invention

It is known that the use of a flexural pivot makes it possible replace the actual pivot of a balance, and the elastically returned balance spring. This has the advantage of eliminating pivot friction. Flexural pivots are known to have a non-linear elastic restoring force that makes the resonator anisochronous, i.e. the frequency depends on the amplitude of oscillation, and to have undesired movements of the instantaneous axis of rotation, which makes the rate of the resonator sensitive to its position in the field of gravity.

The problem of non-linear elastic restoring force is difficult to overcome, and existing geometric solutions to improve the linearity of the elastic restoring force and consequently make the resonator isochronous within a given range of angular amplitude, require it to be manufactured on several levels. WO Patent 2016096677 in the name of The Swatch Group Research & Development Ltd, incorporated herein by reference, thus discloses a timepiece resonator with crossed strips in two superposed planes and expounds the importance of the value of a particular angle, in order to optimise the linearity of the elastic restoring force and consequently make the resonator isochronous within a given range of angular amplitude. However, such a flexural pivot cannot be etched in a single two dimensional etch, which complicates the manufacturing thereof.

EP Patent 3021174 in the name of LVMH SWISS MFT SA discloses a monolithic timepiece regulator made in a single plate, including a rigid external element, a rigid internal element, and elastic suspensions connecting the rigid external element to the rigid internal element and allowing movements of oscillation. The rigid internal element includes arms that are rigidly connected to each other, leaving free angular spaces between them, in which there are elastic suspensions. This document illustrates a compact system, including pivots that comprise flexible strips, however this document does not describe any features able to ensure isochronism (rate independent of amplitude), or insensitivity to position in space, in the field of gravity (rate independent of position). The architecture of the strips and of the intermediate supports is specific: it is noted that the ends of the two strips close to the axis of rotation are connected to two different intermediate supports, and are not connected to the same rigid element, they are therefore not RCC (Remote Compliance Centre) pivots; it may also be noted that the clamping points close to the pivot axis of the first pivot are not rigidly connected by the intermediate support to the clamping points distant from the pivot axis of the second pivot. Finally, the system described is formed of three identical elementary flexible structures, repeated every 120° and combined like springs in parallel. Given that each of these structures defines its own axis of rotation, the entire system is manifestly hyperstatic, i.e. there are more stresses than necessary for operation of the system This consequently destroys the linearity of the relation between the deformation and elastic return torque, so much so that the resonator cannot be isochronous. The teaching of this document does not allow specific geometric parameters to be determined. WO Patent 2012/010408 in the name of NIVAROX-FAR discloses an oscillating mechanism for a timepiece movement comprising a first rigid element and a second rigid element, each arranged to be attached to a different element of the movement, and one of which is movable with respect to the other and pivots about a theoretical pivot axis. This oscillating mechanism is a flexible, variable-geometry mechanism, while made in a monolithic manner, and comprises first elastic return means forming a direct or indirect elastic connection between said first rigid element and an intermediate rigid element, and includes at least second elastic return means, which form a direct or indirect elastic connection between the intermediate rigid element and the second rigid element. The first rigid element, the first elastic return means, the intermediate rigid element, the second elastic return means, and the second rigid element, are coplanar and are arranged to deform in this plane. More particularly, the first elastic return means include at least one elastic strip, and the second elastic return means include at least one elastic strip. Again, the system described is hyperstatic since it is formed of two elementary flexible structures which are repeated every 180° and combined in parallel.

EP Patent 2645189 in the name of NIVAROX-FAR discloses a timepiece escapement mechanism including a balance and an escape wheel. The transmission of impulses between the balance and the escape wheel is achieved by a monolithic flexible mechanism including at least one feeler spindle cooperating with the escape wheel or, respectively, with the balance, and this monolithic flexible mechanism is connected by at least one flexible strip to a fixed structure of the timepiece, or respectively to the escape wheel. More particularly, this monolithic flexible mechanism is a flexible, constant force, bistable buckled pallet-lever, or Swiss lever, and this pallet-lever includes a lever provided with a fork and guard pin and comprising a pivoting flexible guided arbor, the pallet-lever cooperating with a two-level escape wheel comprising impulse pins on the two respective levels, and the pallet-lever also carries, on a different level to the flexible arbor, an impulse pin arranged to cooperate with the escape wheel to move the pallet-lever in proximity to its tilting point.

EP Patent 2911012 in the name of CSEM discloses a rotary oscillator for timepieces comprising a support element to allow assembly of the oscillator in a timepiece, a balance, a plurality of flexible strips connecting the support element to the balance and capable of exerting a return torque on the balance wheel, and a felloe mounted integrally with the balance. This plurality of flexible strips comprises at least a first flexible strip disposed in a first plane perpendicular to the plane of the oscillator, and a second flexible strip disposed in a second plane perpendicular to the plane of the oscillator and secant with the first plane. The geometric axis of oscillation of the oscillator is defined by the intersection of the first plane and the second plane, this geometric axis of oscillation crossing the first and second strips at 7/8ths of their respective length. More particularly, the plurality of flexible strips includes one pair formed of a first and second strip of identical geometry and disposed in the first plane, and a third strip disposed in a second plane, inserted between the first and second strip and having a height which is twice that of the first or second strip.

SUMMARY OF THE INVENTION

The invention proposes to achieve a high quality factor mechanical resonator with the aid of an inertia part, such as a balance, supported by a rotational guiding arrangement with flexible strips, also called a flexural pivot, which also acts as an elastic return means. This resonator is desired to be isochronous (rate independent of amplitude) and insensitive to positions in the field of gravity (rate independent of position).

The invention seeks to combine the advantages of the two known two-dimensional and three-dimensional geometries, in a simple, economical and therefore two-dimensional embodiment.

The invention therefore concerns a timepiece resonator mechanism according to claim 1.

The invention also concerns a timepiece movement including at least one such resonator mechanism.

The invention also concerns a watch including at least one movement of this type.

BRIEF DESCRIPTION OF THE DRAWINGS

Other features and advantages of the invention will appear upon reading the following detailed description, with reference to the annexed drawings, in which.

DETAILED DESCRIPTION OF PREFERRED EMBODIMENTS

Figure 1:
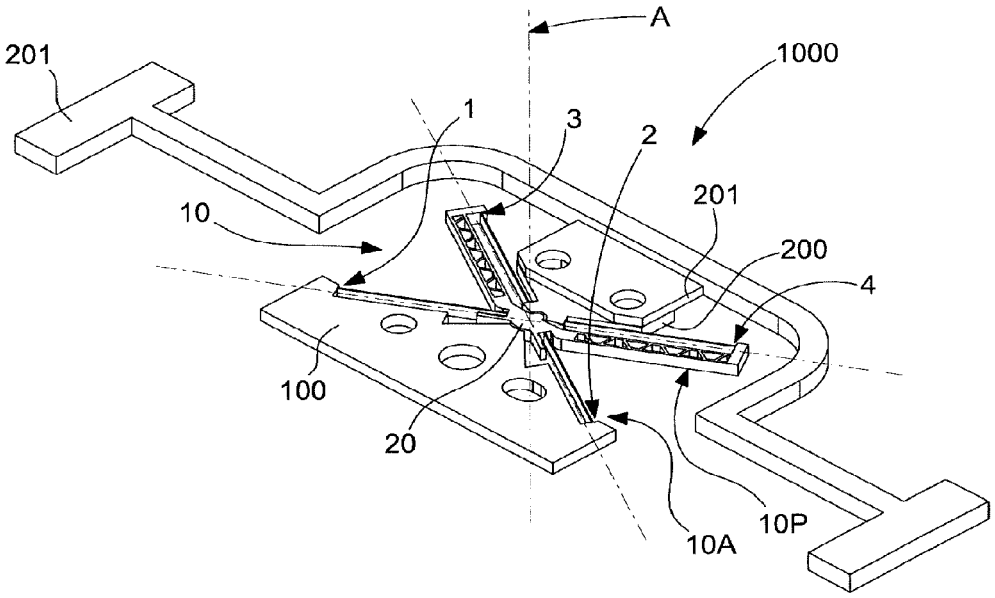
FIG. 1 represents a schematic and perspective view of a mechanical resonator according to the invention, comprising, between a first support arranged to be directly or indirectly attached to the structure of a timepiece movement, and a movable pivoting weight on which is assembled a balance with arms, two RCC flexural pivots mounted in series and head-to-tail about an intermediate rotary support and having the same virtual pivot axis, and each including two straight flexible strips, with the centre of mass of the assembly formed by the movable pivoting weight and the added balance coinciding with the virtual pivot axis.

The invention concerns a timepiece resonator mechanism 1000, comprising a first, fixed or movable, rigid support 100, with a first anchor 1 and a second anchor 2, to which is attached a flexural pivot mechanism 10, which defines a virtual pivot axis A, about which rotatably pivots a rigid pivoting weight 200.

This flexural pivot mechanism 10 is a 2D-flexural pivot, i.e. it can be made in one plane.

This flexural pivot mechanism 10 allows rigid pivoting weight 200 to make a rotation about virtual pivot axis A, relative to first rigid support 100. It is formed of two RCC (Remote Centre Compliance, i.e. offset centre of rotation) flexural pivots whose axes of rotation coincide and which are connected by an intermediate rigid rotary support 20. The two RCC pivots are thus placed in series, but head-to-tail with respect to each other, so that their undesired movements offset each other.

The invention is isostatic in the sense that the relative motion of the parts occurs without excessive stress, due to the absence of other elements placed in parallel.

An elementary pivot with flexible strips is an assembly formed of two rigid parts R1 and R2 which are connected by two flexible strips L1 and L2 which do not touch each other. At rest, strips L1 and L2 are straight and not parallel, such that the extension of said strips defines a crossing point A. The two rigid parts R1 and R2 can make a relative rotational motion about the axis perpendicular to the plane passing through A.

Figure 10:
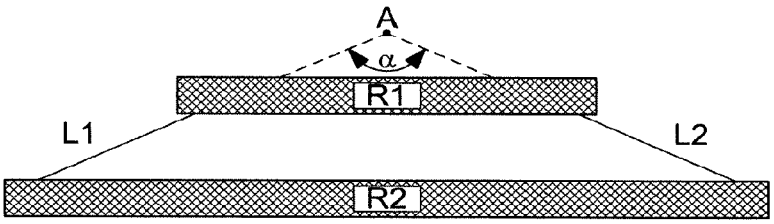
FIG. 10 shows a schematic plan view of an RCC pivot.

An RCC pivot (Remote Compliance Centre), illustrated in FIG. 10, is an elementary pivot with flexible strips, wherein the crossing point A is located beyond the strips. It is formed of two strips L1 and L2 of the same length L, and the clamping points of strips L1 and L2 in rigid part R1 are equidistant from axis of rotation A. RCC pivots are well known to those skilled in the art (see the work by S. Henein, "Conception des guidages flexibles" [*Design of flexural pivots*], Presses polytechniques et universitaires romandes, 2001, page 101).

The geometry of an RCC pivot is characterized by two parameters: (1) the angle $\alpha$ between its two strips and (2) the ratio D/L where D is the distance between axis of rotation A and the clamping point of the strips farthest therefrom, and L is the length of each of the two strips.

The invention includes a flexural pivot mechanism formed of two RCC pivots placed in series, such that:

- the two RCC pivots of which it is composed are located in the same plane;
- the two RCC pivots of which it is composed have the same axis of rotation A;
- the two RCC pivots of which it is composed have the same parameters α et D/L.

Figure 11:
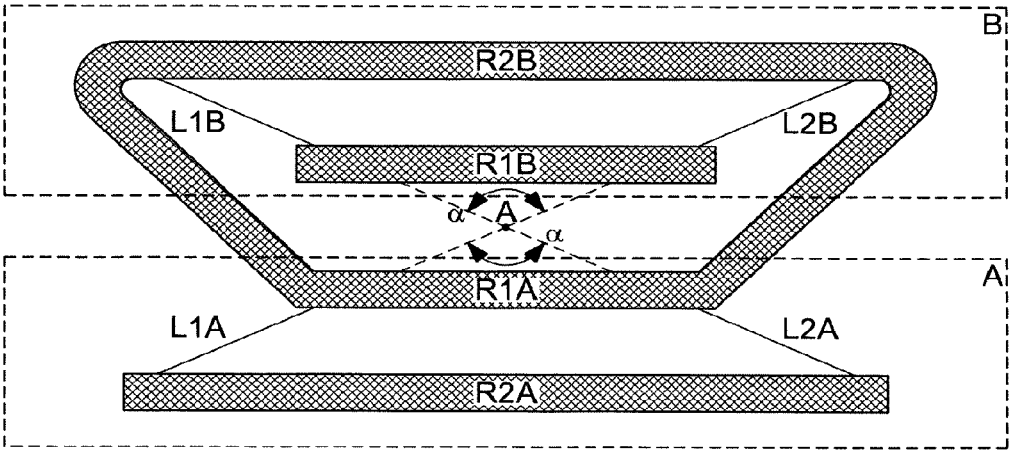
FIG. 11 represents a schematic plan view of a pivot with flexible strips comprising two symmetrical RCC pivots placed in series and head-to-tail.

Further, the rigid part closest to the axis of rotation of one of the two pivots (R1A in FIG. 11) is rigidly connected to the rigid part farthest from the axis of rotation of the other pivot (R2B in FIG. 11). The two RCC pivots are thus said to be placed in series and head-to-tail, as seen in FIG. 11.

The flexural pivot mechanism of the invention is thus formed of only three rigid parts and four strips located in the plane of the guiding arrangement. In order to ensure that the pivoting guiding arrangement is isostatic, it is important that there is no other flexible connection between said three rigid parts in said plane of the guiding arrangement. Nonetheless, it is entirely possible to envisage disposing another flexural pivot mechanism in another plane, parallel to the plane of the first guiding arrangement and remote therefrom. This second flexural pivot mechanism may be connected in series, or in parallel, to the first pivoting guiding arrangement as required.

The first rigid part (R1B in FIG. 11) can be attached to the main plate and an inertia weight, notably a balance, can be attached to a third rigid part (R2A in FIG. 11). The reverse is also possible.

One of the four segments of the intermediate rigid part may be discontinuous. This is the case in the Figures of the illustrated non-limiting variant. However, it is important that the four clamping points of the strips in the intermediate part (L1A, L2A in R1A and L1B, L2B in R2B in FIG. 11) are rigidly connected to each other.

Figure 6:
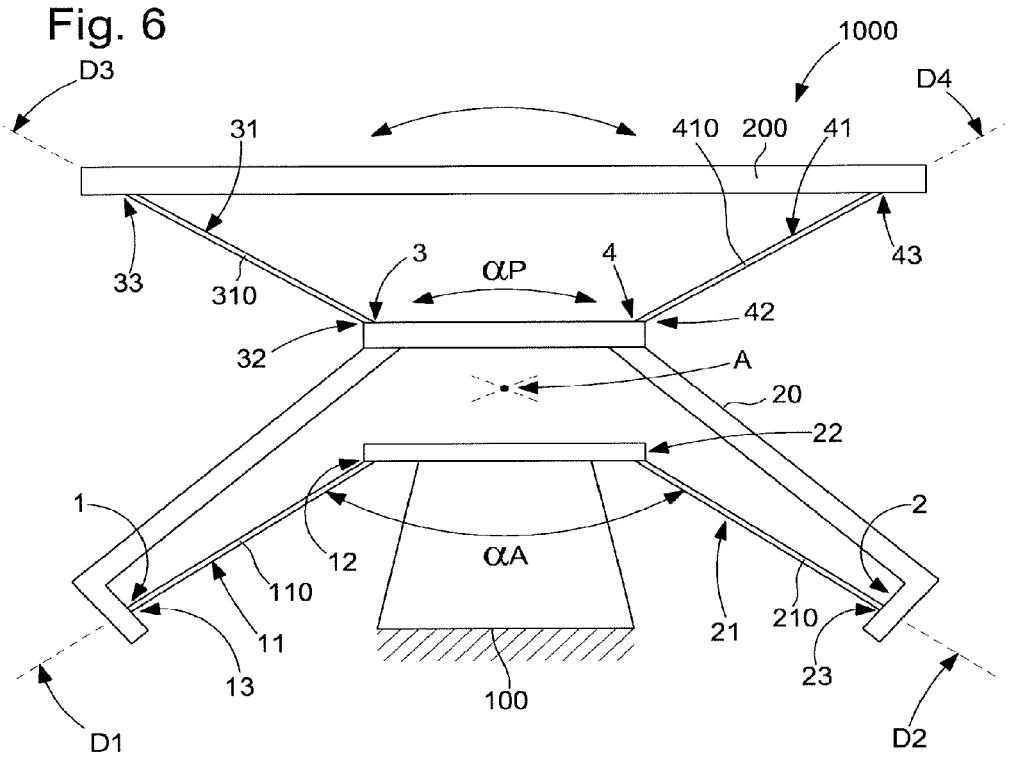
FIGS. 6 to 8 illustrate other variants of geometric arrangements.
Figure 7:
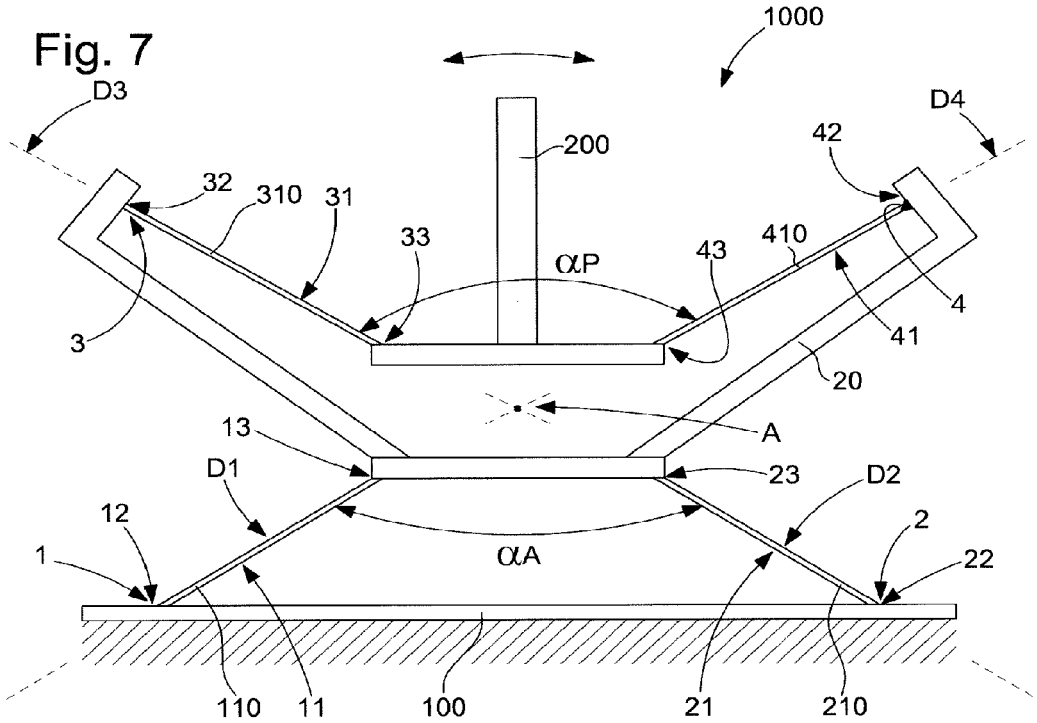
Figure 8:
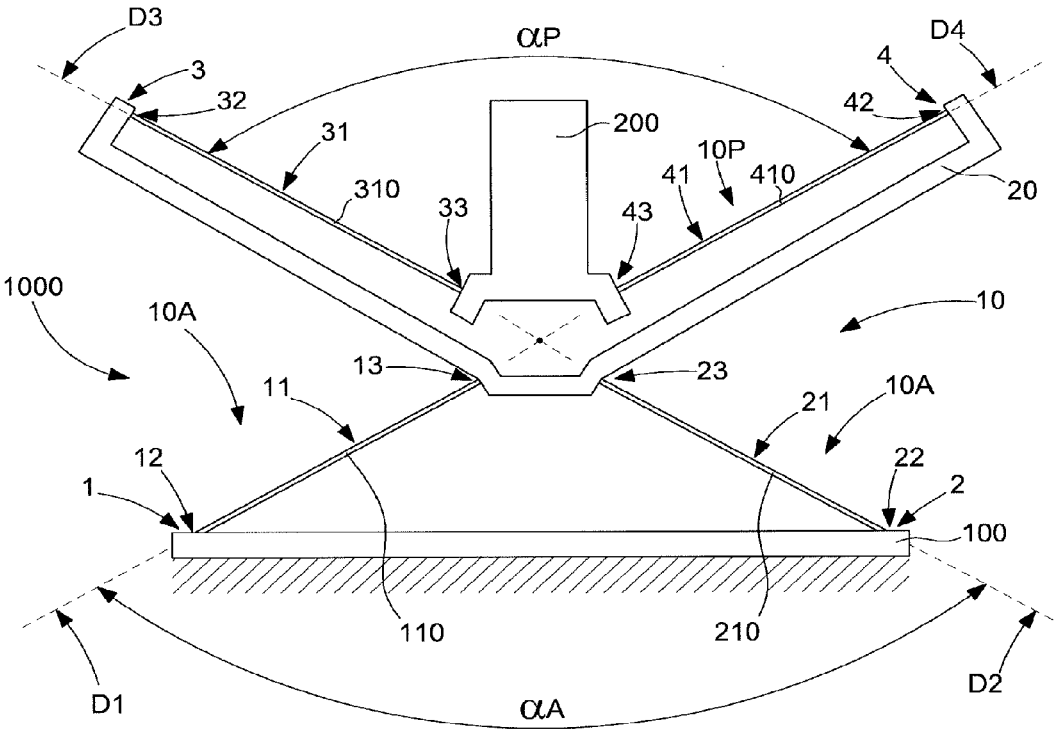
Figure 9:
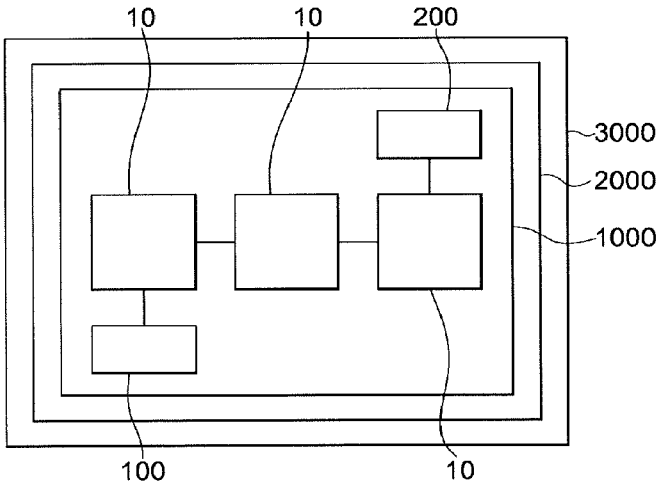
FIG. 9 is a block diagram representing a watch with a movement incorporating a resonator according to the invention, which comprises several flexural pivot mechanisms disposed in series.

It is understood that the clamping points close to virtual pivot axis A of the first RCC pivot are rigidly connected, via intermediate rotary support 20, to the clamping points remote from virtual pivot axis A of the second RCC pivot, or vice versa, as seen in FIGS. 6 and 7.

Thus, flexural pivot mechanism 10 includes a front RCC flexural pivot 10A and a back RCC flexural pivot 10P, which are mounted in series with each other and head-to-tail, about the common virtual pivot axis A, and which incorporate flexible elastic elements.

Front RCC flexural pivot 10A includes, between first support 100 and an intermediate rotary support 20, two front resilient assemblies 11, 21, formed, in the embodiment of the Figures, by two straight flexible front strips 110, 210, of the same front length LA between their clamping points, defining two linear front directions D1, D2, which intersect at virtual pivot axis A, and which define with virtual pivot axis A, a front angle αA, and wherein the respective anchors of the two straight flexible front strips 110, 210, farthest from virtual pivot axis A are both at the same front distance DA from virtual pivot axis A.

Similarly, back RCC flexural pivot 10P includes, between intermediate rotary support 20, which includes a third anchor 3 and a fourth anchor 4, and pivoting weight 200, two back resilient assemblies 31, 41, formed, in the embodiment of the Figures, by two straight flexible back strips 310, 410, of the same back length LP between their clamping points, defining two linear back directions D3, D4, which intersect at virtual pivot axis A, and which define with virtual pivot axis A, a back angle αP, and wherein the respective anchors of the two straight flexible back strips 310, 410, farthest from virtual pivot axis A are both at the same back distance DP from virtual pivot axis A.

Further, flexural pivot mechanism 10 is planar.

The invention consists in optimising the angle between the elastic elements of each RCC flexural pivot, in order for the pivot to have a linear elastic restoring force, so that the mechanical resonator is isochronous within a given range of angular amplitude.

Figure 2:
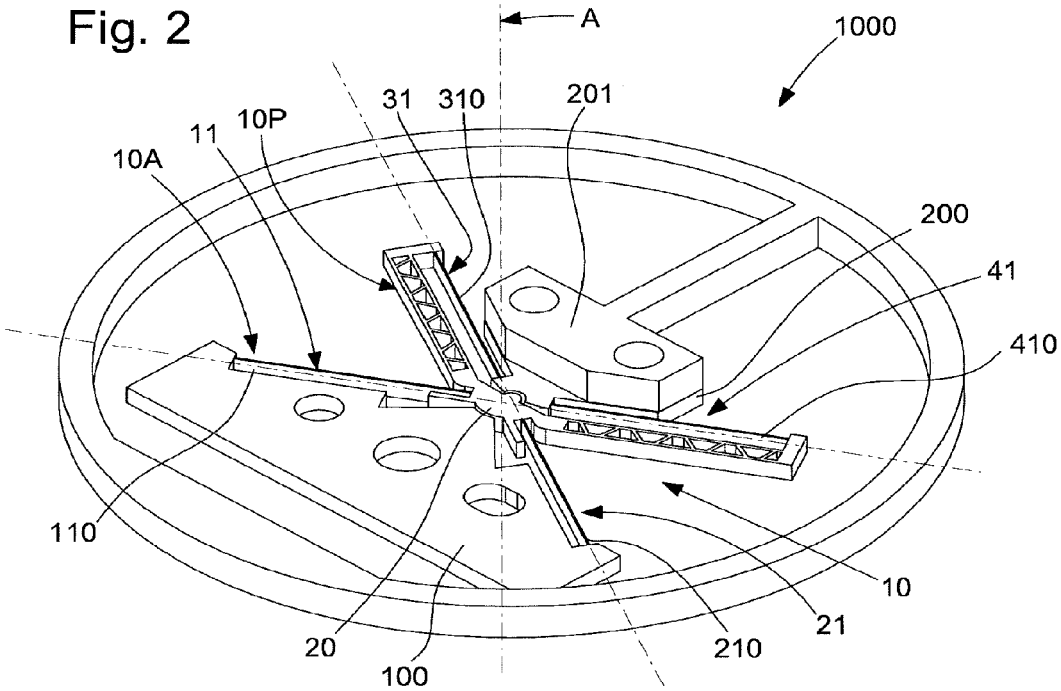
FIG. 2 is a variant wherein the added balance comprises a circular rim.
Figure 3:
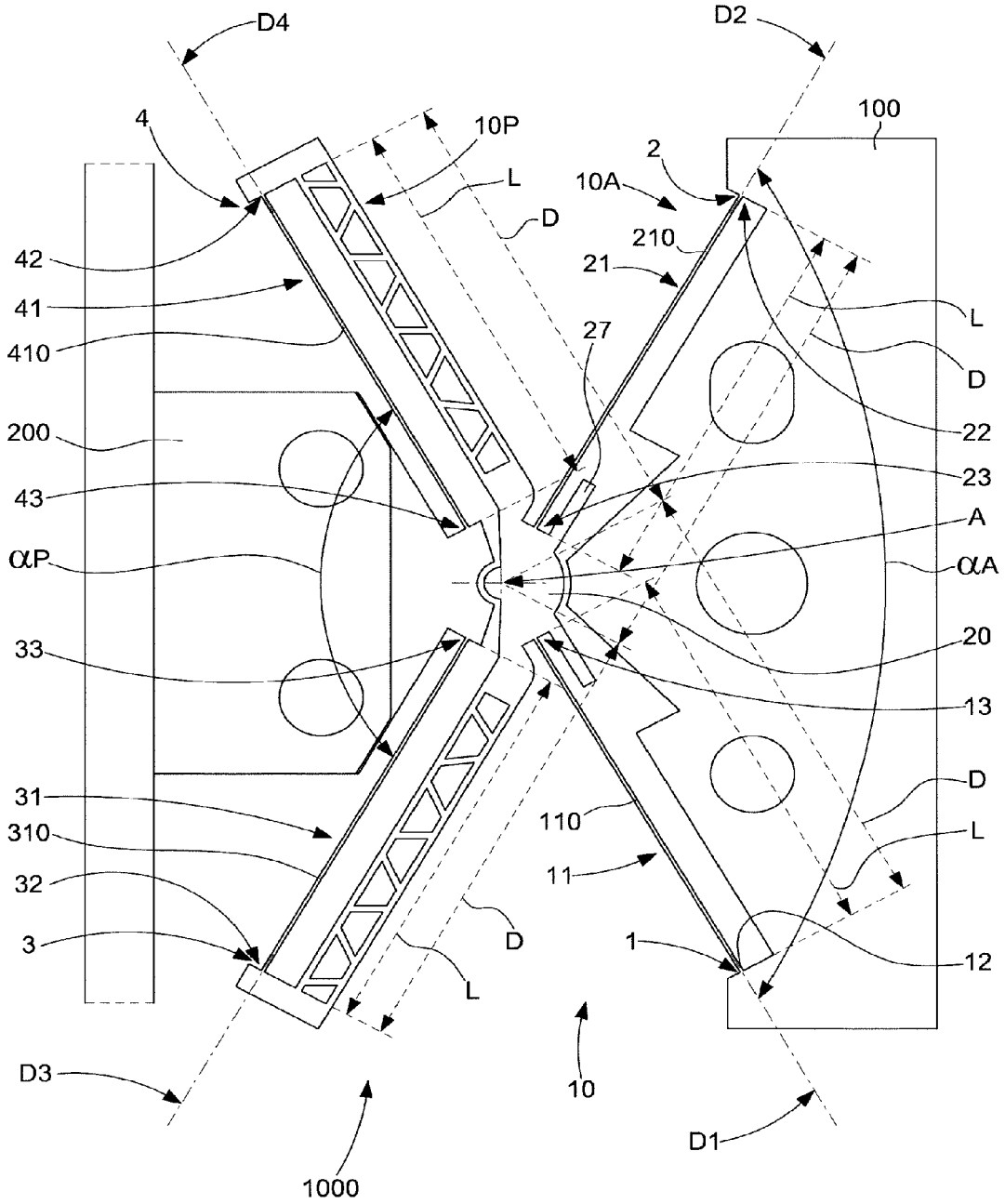
FIG. 3 shows a schematic, plan view of the central portion of the resonator of FIG. 1.

According to the invention, the centre of inertia of the assembly formed by pivoting weight 200 and any added inertia weight 201 carried by pivoting weight 200, as in the non-limiting variants illustrated in FIGS. 1 and 2, lies on virtual pivot axis A or in immediate proximity thereto, and the mechanical resonator is isochronous if:

front angle αA expressed in degrees is comprised between:

$$107+5/[(DA/LA)-(2/3)] \text{ and } 114.5+5/[(DA/LA)-(2/3)],$$

and back angle αP expressed in degrees is comprised between:

$$107+5/[(DP/LP)-(2/3)] \text{ and } 114.5+5/[(DP/LP)-(2/3)].$$

In a particular variant, front angle αA and back angle αP are equal to a common angle α. More specifically, this common angle α is close to 118°.

In a preferred variant, the front distance DA and the back distance DP are equal to a common distance D, and front length LA and back length LP are equal to a common length L.

Common angle α is therefore comprised between:

$$107+5/[(D/L)-(2/3)] \text{ and } 114.5+5/[(D/L)-(2/3)].$$

The optimum value of angle α depends mainly on the ratio D/L, but it also depends on the clamping point radii of the strips, on the cross-section aspect ratio of the strips, and on the thickness of the SiO2 layer used for temperature compensation.

Figure 5:
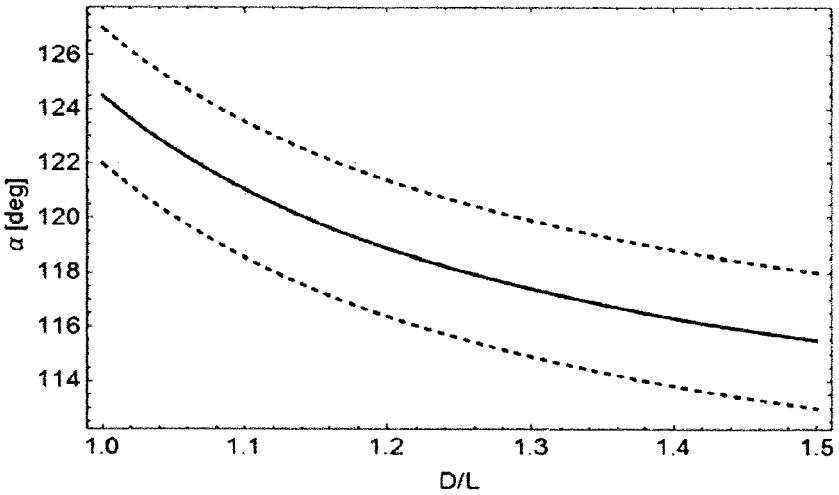
FIG. 5 is a graph representing the optimum value of the angle between the two strips of each RCC flexural pivot, as a function of the ratio between, on the one hand, the distance from the clamping point of a strip, opposite the pivot axis, and on the other hand, the length of the strip concerned.

An optimum curve, for particular values of the clamping point radius and of the aspect ratio of the strips, is represented in a solid line in FIG. 5, which shows the evolution of optimum angle α, as a function of ratio D/L.

Naturally, different values of the clamping point radii, and of the cross-section aspect ratio of the strips result in different values of optimum angle α. This angular range is represented in FIG. 5 between discontinuous lines.

More particularly, angle α and parameter D/L satisfy the relation:

$$107+5/((D/L)-(2/3))<\alpha<112+5/((D/L)-(2/3)).$$

More particularly, in the variants illustrated in the Figures, the first front resilient assembly 11, the second front resilient assembly 21, the first back resilient assembly 31, and the second back resilient assembly 41 are each formed of a straight flexible strip 110, 210, 310, 410.

In another variant that is not illustrated in the Figures, first front resilient assembly 11, second front resilient assembly 21, first back resilient assembly 31, and second back resilient assembly 41 each include an alternation of straight flexible strips and intermediate elements that are more rigid than the straight flexible strips, aligned in the respective directions D1, D2, D3, D4.

To obtain a high quality factor mechanical resonator, it is advantageous to add an inertial element 201 to pivoting weight 200, or to incorporate it therein, and to attach first rigid support 100 to a main plate or a bridge of the timepiece movement, or any other element capable of acting as a support for the flexural pivot resonator, for example, in a non-limiting manner, a connection element for a tuning fork, or an anti-shock element which is allowed to move only in the event of a violent shock, to decrease the acceleration to which the resonator is subjected. Naturally, the fixed part and the movable part represented here are permutable. This inertial element may be a disc, a ring such as a balance rim as seen in FIG. 2, or simply an arm as seen in FIG. 1. It is important for the centre of mass of the inertial element to be substantially aligned with virtual pivot axis A.

To avoid undesirable fundamental modes of vibration, it is advantageous to make rigid intermediate rotary support 20 thinner with recesses 209, so as to reduce its inertia, while giving it much greater stiffness than that of the flexible strips forming resilient assemblies 11, 21, 31 and 41, as seen in FIGS. 1 to 4.

Likewise, when the elastic elements include intermediate elements that are more rigid than the straight flexible strips, these intermediate elements are advantageously also made thinner.

Figure 4:
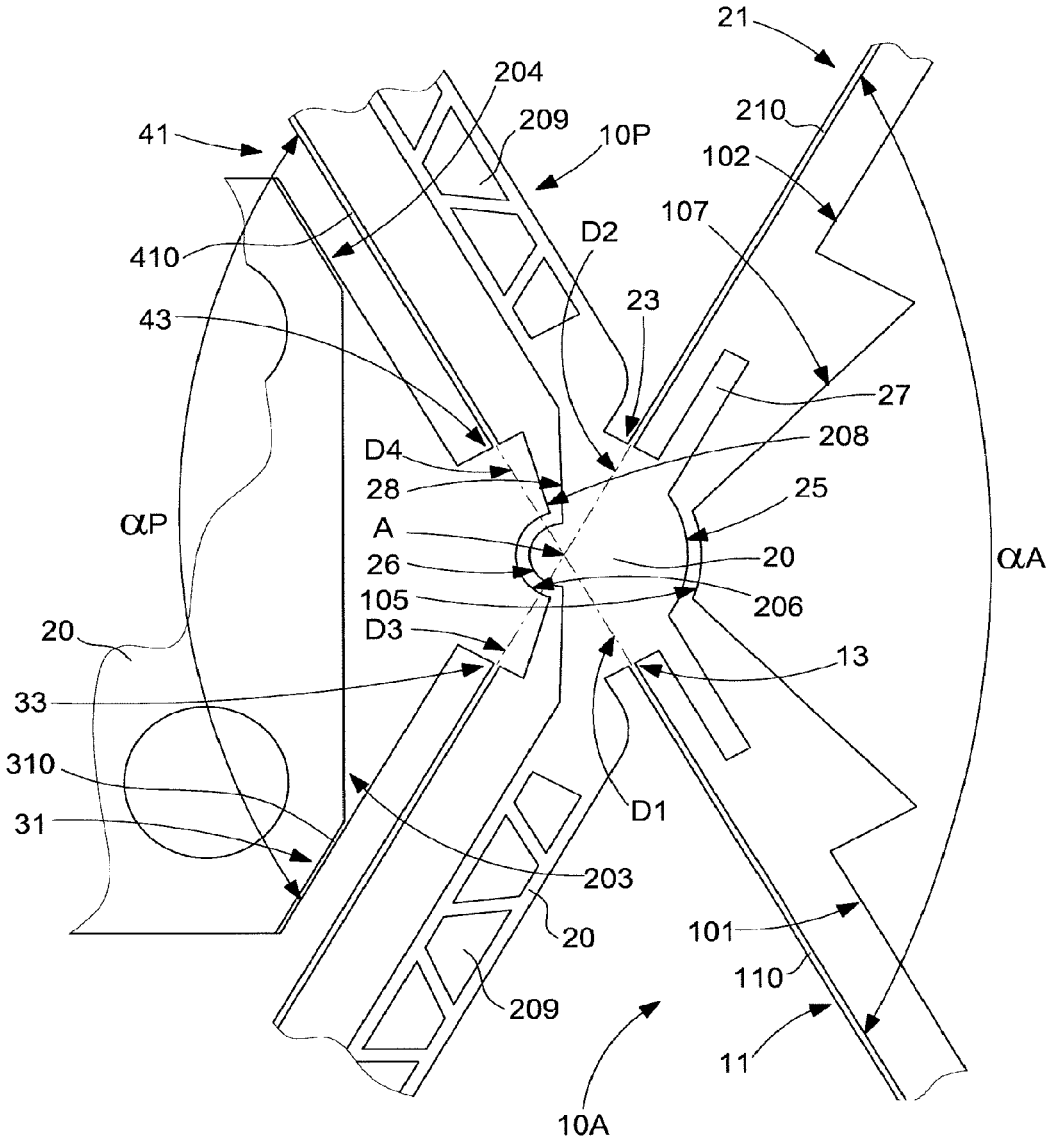
FIG. 4 is a detail of the same central portion showing the various banking surfaces for anti-shock protection comprised in the resonator.

Another advantageous variant, concerning all the embodiments, consists in arranging rigid parts 100, 20, 200, very close to each other about virtual pivot axis A, so that they act as radial and/or angular anti-shock banking members, to prevent breakage of the strips, as seen with surfaces 105, 25, 26, 206, 28, 208, of FIG. 4, in particular oblique surfaces 28 and 208 which contribute greatly to the shock resistance of the system. Or some of the rigid parts may be equipped with banking arms 27 arranged to cooperate in abutment, in case of shock, with complementary surfaces 107 comprised in first support 100, as seen in FIG. 4, where intermediate rotary support 20 carries such banking arms 27.

The invention can be implemented with strips of variable thickness. The optimum angle between the strips must then be adapted accordingly.

The essential is to respect the symmetry of flexibility with respect to the bisector of angle $\alpha A$, and with respect to virtual pivot axis A.

The invention is particularly well-suited to a monolithic embodiment.

In an advantageous embodiment, first support 100, pivoting weight 200 and flexural pivot mechanism 10 form a one-piece assembly. This one-piece assembly can be made, either by conventional machining, or, in a particular and non-exhausting manner, by technologies of the MEMS or LIGA type or 3D printing or additive manufacturing by laser or similar, of silicon, quartz, DLC, metal alloys, glass, ruby, sapphire or another ceramic, or loaded or unloaded polymers, or similar, temperature compensated, notably by local growth of silicon dioxide, in certain areas of the part arranged for this purpose, when this one-piece assembly is made of silicon. Naturally, still other materials can be used, in some cases at the cost of temperature compensation. Amorphous or crystalline metal alloys may be cited here in particular and in a non-limiting manner.

When pivoting weight 200 carries an added inertial weight 201, flexural pivot mechanism 10 is advantageously made of silicon, oxidised so that the entire resonator mechanism 1000, with this added inertial weight 201, is temperature compensated.

Timepiece resonator mechanism 1000 may comprise a plurality of such flexural pivot mechanisms 10 mounted in series, to increase the total angular travel, disposed in parallel planes, and about the same virtual pivot axis A. Such a part can be formed by assembling two pieces etched on one level, or it may be etched in SOI silicon on two levels.

Two flexural pivot mechanisms can advantageously be used in a tuning fork configuration, to eliminate reaction at the support; this can be extrapolated to a number N of flexural pivot mechanisms.

The invention also concerns a timepiece movement 2000 including at least one such resonator mechanism 1000.

The invention also concerns a watch 3000 including at least one movement 2000 of this type.

The invention provides several advantages:

good isochronism, rate independent of position in the field of gravity, rate independent of amplitude;

ease of manufacture, owing to the grouping of functional elements in a single plane, achievable in two dimensions, by a single etch in silicon or similar, or by wafer forming or cutting, by electrical discharge machining, laser, water jet, additive manufacturing or other means.

What is claimed is:

1. A timepiece resonator mechanism comprising a first support with a first anchor and a second anchor, wherein a flexural pivot mechanism is attached to said first support, wherein said flexural pivot mechanism defines a virtual pivot axis about which rotatably pivots a pivoting weight, and wherein said flexural pivot mechanism includes at least one front RCC flexural pivot and one back RCC flexural pivot, mounted in series and head-to-tail relative to each other about said virtual pivot axis, said front RCC flexural pivot including, between said first support and an intermediate rotary support, two straight flexible front strips of the same front length LA between the clamping points thereof, defining two linear front directions which intersect at said virtual pivot axis and which define, with said virtual pivot axis, a front angle, and wherein the respective anchors of said two straight flexible front strips farthest from said virtual pivot axis are both at the same front distance DA from said virtual pivot axis, and said back RCC flexural pivot including, between said intermediate rotary support, which includes a third anchor and a fourth anchor, and said pivoting weight, two straight flexible back strips of the same back length LP between the clamping points thereof, defining two linear back directions which intersect at said virtual pivot axis and which define, with said virtual pivot axis, a back angle, and wherein the respective anchors of said two straight flexible back strips farthest from said virtual pivot axis are both at the same back distance DP from said virtual pivot axis, wherein said flexural pivot mechanism is planar, wherein the center of inertia of the assembly formed by said pivoting weight and any added inertial weight carried by said pivoting weight is on said virtual pivot axis or in immediate proximity thereto, wherein said front angle expressed in degrees is comprised between:

$$107+5/[(DA/LA)-(2/3)] \text{ and } 114.5+5/[(DA/LA)-(2/3)],$$

wherein said back angle expressed in degrees is comprised between:

$$107+5/[(DP/LP)-(2/3)] \text{ and } 114.5+5/[(DP/LP)-(2/3)].$$

2. The timepiece resonator mechanism according to claim 1, wherein said front angle and said back angle are equal.

3. The timepiece resonator mechanism according to claim 2, wherein said front length and said back length are equal to a common length, and wherein said front distance and said back distance are equal to a common distance.

4. The timepiece resonator mechanism according to claim 3, wherein said front angle and said back angle are equal to a common angle, expressed in degrees, and wherein said common angle and the ratio between said common length L and said common distance D satisfy the relation: $107+5/((D/L)-(2/3))<\alpha<112+5/((D/L)-(2/3))$.

5. The timepiece resonator mechanism according to claim 3, wherein said front angle and said back angle are equal to a common angle ($\alpha$), expressed in degrees, which is expressed as a function of the ratio between said common length L and said common distance D and which is equal to $109.5°+5/[(D/L)-(2/3)]$.

6. The timepiece resonator mechanism according to claim 1, wherein said intermediate rotary support is made thinner by recesses to minimize the mass thereof and to prevent undesirable fundamental modes of vibration.

7. The timepiece resonator mechanism according to claim 1, wherein said first support, said pivoting weight, and said flexural pivot mechanism are arranged very close to each other about said virtual pivot axis and include surfaces forming anti-shock banking members to prevent breakage of said flexible strips.

8. The timepiece resonator mechanism according to claim 7, wherein said intermediate rotary support comprises banking arms arranged to cooperate in abutment in case of shock with complementary surfaces comprised in said first support.

9. The timepiece resonator mechanism according to claim 1, wherein said first support, said pivoting weight, and said flexural pivot mechanism form a one-piece assembly.

10. A timepiece resonator movement according to claim 9, wherein said one-piece assembly is a temperature-compensated silicon assembly.

11. The timepiece resonator movement according to claim 9, wherein said pivoting weight carries an added inertia weight, and wherein said flexural pivot mechanism is made of silicon, oxidized such that said complete resonator mechanism with said added inertia weight is temperature-compensated.

12. The timepiece resonator mechanism according to claim 1, wherein said resonator mechanism comprises a plurality of said flexural pivot mechanisms mounted in series, to increase the total angular travel, disposed in parallel planes, and about the same said virtual pivot axis.

13. A timepiece movement including at least one timepiece resonator mechanism according to claim 1.

14. A watch including at least one movement according to claim 13.

* * * * *